US009889657B2

(12) United States Patent
Watanabe et al.

(10) Patent No.: US 9,889,657 B2
(45) Date of Patent: Feb. 13, 2018

(54) LIQUID EJECTING HEAD AND LIQUID EJECTING APPARATUS

(71) Applicant: SEIKO EPSON CORPORATION, Tokyo (JP)

(72) Inventors: Shunsuke Watanabe, Matsumoto (JP); Shingo Tomimatsu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/263,441

(22) Filed: Sep. 13, 2016

(65) Prior Publication Data

US 2017/0087834 A1 Mar. 30, 2017

(30) Foreign Application Priority Data

Sep. 25, 2015 (JP) ..... 2015-188416

(51) Int. Cl.
*B41J 2/175* (2006.01)
*B41J 2/14* (2006.01)

(52) U.S. Cl.
CPC ..... *B41J 2/1433* (2013.01); *B41J 2/14233* (2013.01); *B41J 2202/08* (2013.01); *B41J 2202/11* (2013.01)

(58) Field of Classification Search
CPC ..... B41J 2/175; B41J 2202/20; B41J 2/1623; B41J 2/17513; B41J 2002/14362; B41J 2202/19; B41J 2/14427; B41J 2/17523; B41J 2/1433; B41J 2/14
USPC ..... 347/40, 47, 65, 71, 84–86
See application file for complete search history.

(56) References Cited

U.S. PATENT DOCUMENTS

2013/0127956 A1 5/2013 Watanabe et al.
2015/0258789 A1* 9/2015 Togashi ..... B41J 2/14201 347/44

FOREIGN PATENT DOCUMENTS

JP 2000-108352 A 4/2000
JP 2013-129191 A 7/2013

* cited by examiner

*Primary Examiner* — Jannelle M Lebron
(74) *Attorney, Agent, or Firm* — Workman Nydegger

(57) ABSTRACT

A liquid ejecting head includes a head main body in which nozzles are arranged along a first direction, a housing fixed to the head main body, a liquid storage chamber that includes a space formed in the housing, and stores the liquid supplied to the nozzles, an introducing port of the liquid communicating with the liquid storage chamber, and a plurality of beam-shaped units that are stretched over an inner wall face of the space in the housing, in which the plurality of beam-shaped units are provided with intervals such that a plurality of flow paths are arranged in the first direction from the introducing port, and, among the plurality of flow paths, a first flow path far away from the introducing port in the first direction has a flow path width in the first direction smaller than that of a second flow path close to the introducing port.

8 Claims, 7 Drawing Sheets

LIQUID EJECTING HEAD AND LIQUID EJECTING APPARATUS

BACKGROUND

1. Technical Field

The present invention relates to a technique for ejecting liquid such as ink.

2. Related Art

In the related art, a liquid ejecting head which ejects liquid such as ink which is filled in a pressure chamber from nozzles has been proposed. For example, in JP-A-2013-129191, a structure in which liquid is supplied to a pressure chamber from a common liquid chamber in which a liquid chamber hollow portion which is formed on the communicating substrate, and a liquid chamber forming hollow portion of a unit case which is fixed to the communicating substrate are caused to communicate with each other is disclosed.

In order to achieve miniaturization of a liquid ejecting head, it is necessary to reduce the wall thickness of the unit case. However, there is a problem in that it is difficult to secure mechanical strength of the liquid ejecting head due to the reduction of the wall thickness.

SUMMARY

An advantage of some aspects of the invention is to improve mechanical strength of constituents forming a space storing liquid An advantage of some aspects of the invention is to provide a liquid ejecting head which includes a head main body in which a plurality of nozzles ejecting liquid are arranged along a first direction; a housing fixed to the head main body; a liquid storage chamber that includes a space formed in the housing, and stores the liquid supplied to the nozzles; an introducing port of the liquid communicating with the liquid storage chamber; and a plurality of beam-shaped units that are stretched over an inner wall face of the space in the housing, in which the plurality of beam-shaped units are provided with intervals such that a plurality of flow paths are arranged in the first direction from the introducing port, and in which among the plurality of flow paths, a first flow path far away from the introducing port in the first direction has a flow path width in the first direction smaller than that of a second flow path close to the introducing port. In the above described configuration, since the beam-shaped unit is provided in the housing, it is possible to improve mechanical strength of the housing compared to a configuration in which the beam-shaped unit is not provided. In addition, since among the plurality of flow paths, the first flow path far away from the introducing port has the flow path width in the first direction smaller than that of the second flow path, the flow rate in the first flow path is increased, and the gap between the inner wall face of the first flow path and the bubble is reduced. Accordingly, it is possible to easily discharge the bubble through the first flow path. Meanwhile, since the second flow path close to the introducing port has the flow path width in the first direction larger than that of the first flow path, it is possible to secure the flow rate of the liquid.

In a preferable aspect of the invention, the liquid storage chamber includes a first space on an upstream side of the plurality of beam-shaped units, and a second space on a downstream side of the plurality of beam-shaped units, and the flow path width of the first flow path in a second direction intersecting the first direction is smaller than a height of the first space in a third direction orthogonal to both the first direction and the second direction. In the above described aspect, since the flow path area of the first flow path is reduced compared to the configuration in which the flow path width of the first flow path in the second direction is larger than the height of the first space, it is possible to increase the flow rate of the liquid passing through the first flow path. Accordingly, it is possible to promote the discharge of the bubble through the first flow path. Since the height greater than the first flow path width is secured in the first space, there is an advantage in that the flow rate of the liquid flowing in a space on the upstream side of the beam-shaped unit is easily secured.

In a preferable aspect of the invention, the flow path width of the first flow path in the first direction is smaller than the height of the first space in the third direction. In the above described aspect, since both the flow path width in the first direction and the flow path width in the second direction of the first flow path far away from the introducing port are reduced, the flow path area of the first flow path is reduced. Accordingly, the effect in which it is possible to promote the discharge of the bubble by the suppression of the gap between the bubble and the inner wall face of the first flow path, and by the increase of the flow rate of the liquid is particularly remarkable.

In a preferable aspect of the invention, the liquid storage chamber includes, from the introducing port, a portion parallel to a plane including the first direction and the second direction, and a portion orthogonal to the plane, and the beam-shaped unit is formed in the orthogonal portion in the liquid storage chamber. In the above described aspect, when the liquid flows from the parallel portion to the orthogonal portion in the liquid storage chamber, since the liquid passes through the flow path formed by the beam-shaped unit, at this time, it is possible to easily discharge the bubble in the first flow path far away from the introducing port while the flow rate of the liquid is secured.

In a preferable aspect of the invention, there is provided a liquid ejecting apparatus that includes the liquid ejecting head according to each of the above exemplified aspects. A preferable example of the liquid ejecting apparatus is a printing apparatus which ejects ink; however, a use of the liquid ejecting apparatus according to the invention is not limited to printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
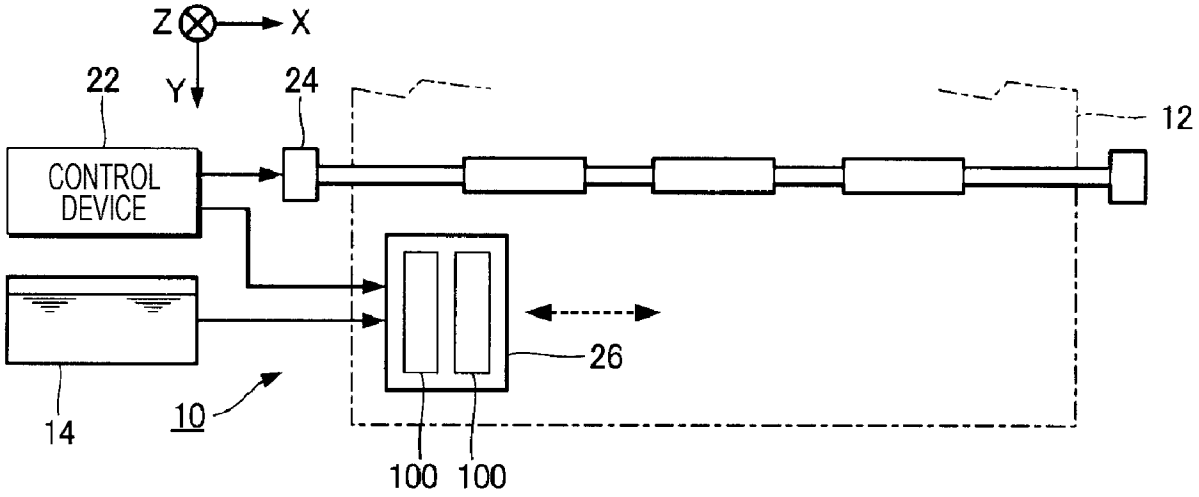
FIG. 1 is a configuration diagram of a printing apparatus according to an embodiment of the invention.

FIG. 1 is a partial configuration diagram of an ink jet printing apparatus 10 according to an embodiment of the invention. The printing apparatus 10 according to the embodiment is a preferable example of a liquid ejecting apparatus which ejects ink as an example of liquid onto a medium (ejecting target) 12 such as a printing sheet, and as exemplified in FIG. 1, the printing apparatus includes a control device 22, a transport mechanism 24, a carriage 26, and a plurality of liquid ejecting heads 100. A liquid container (cartridge) 14 which stores ink is mounted on the printing apparatus 10.

The control device 22 integrally controls each element of the printing apparatus 10. The transport mechanism 24 transports the medium 12 in the Y direction (an example of a first direction) under control of the control device 22. Each liquid ejecting head 100 ejects ink onto the medium 12 from a plurality of nozzles under control of the control device 22. The plurality of liquid ejecting heads 100 are mounted on the carriage 26. The control device 22 causes the carriage 26 to reciprocate in the X direction (an example of a second direction) which intersects the Y direction. A desired image is formed on the surface of the medium 12 when each liquid ejecting head 100 ejects ink onto the medium 12 in parallel with transporting of the medium 12 using the transport mechanism 24 and repeated reciprocating of the carriage 26. In addition, hereinafter, a direction which is perpendicular to an X-Y plane (for example, plane parallel to surface of medium 12) will be denoted by a Z direction. An ink ejecting direction (typically, vertical direction) using each liquid ejecting head 100 corresponds to the Z direction (an example of a third direction).

Figure 2:
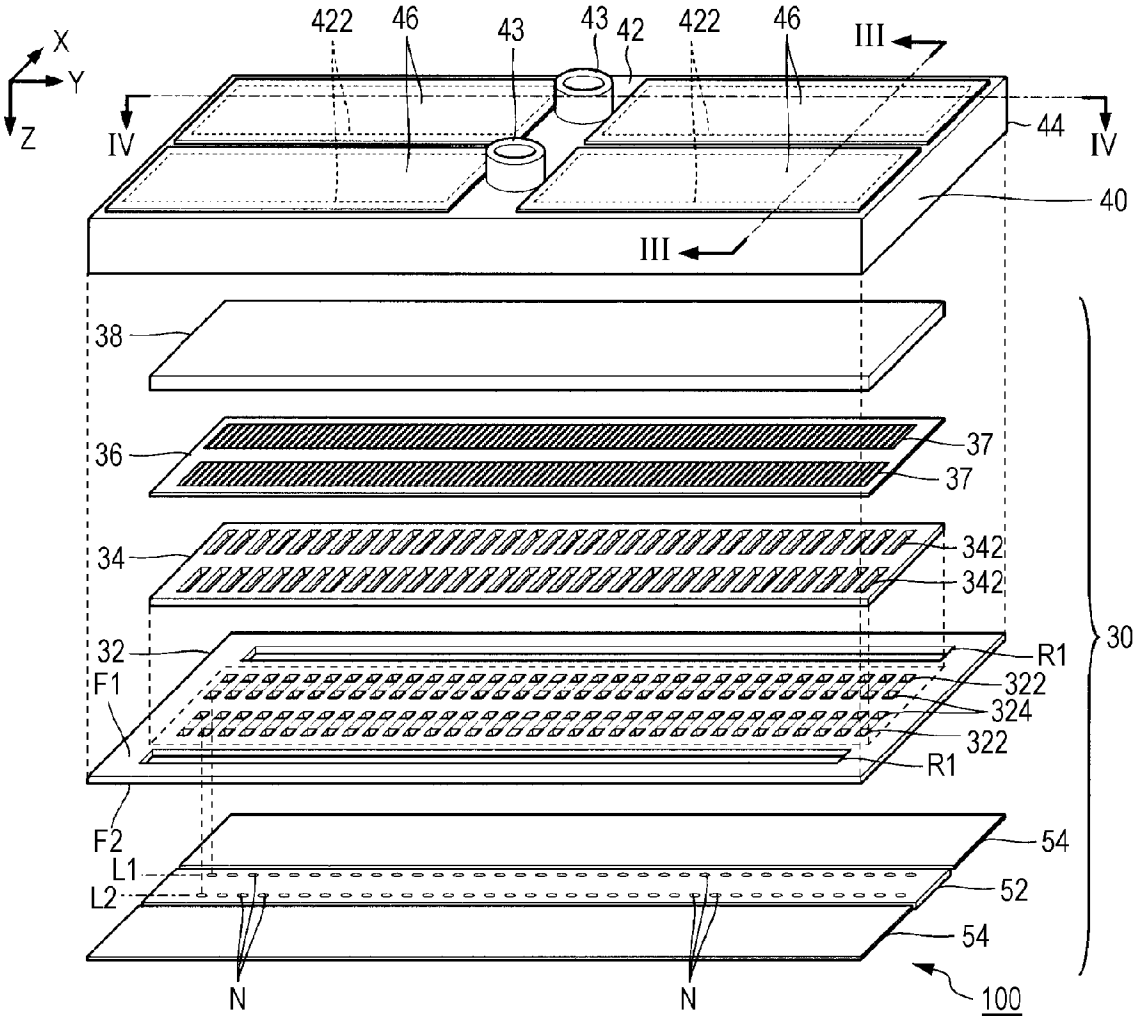
FIG. 2 is an exploded perspective view of a liquid ejecting head.
Figure 3:
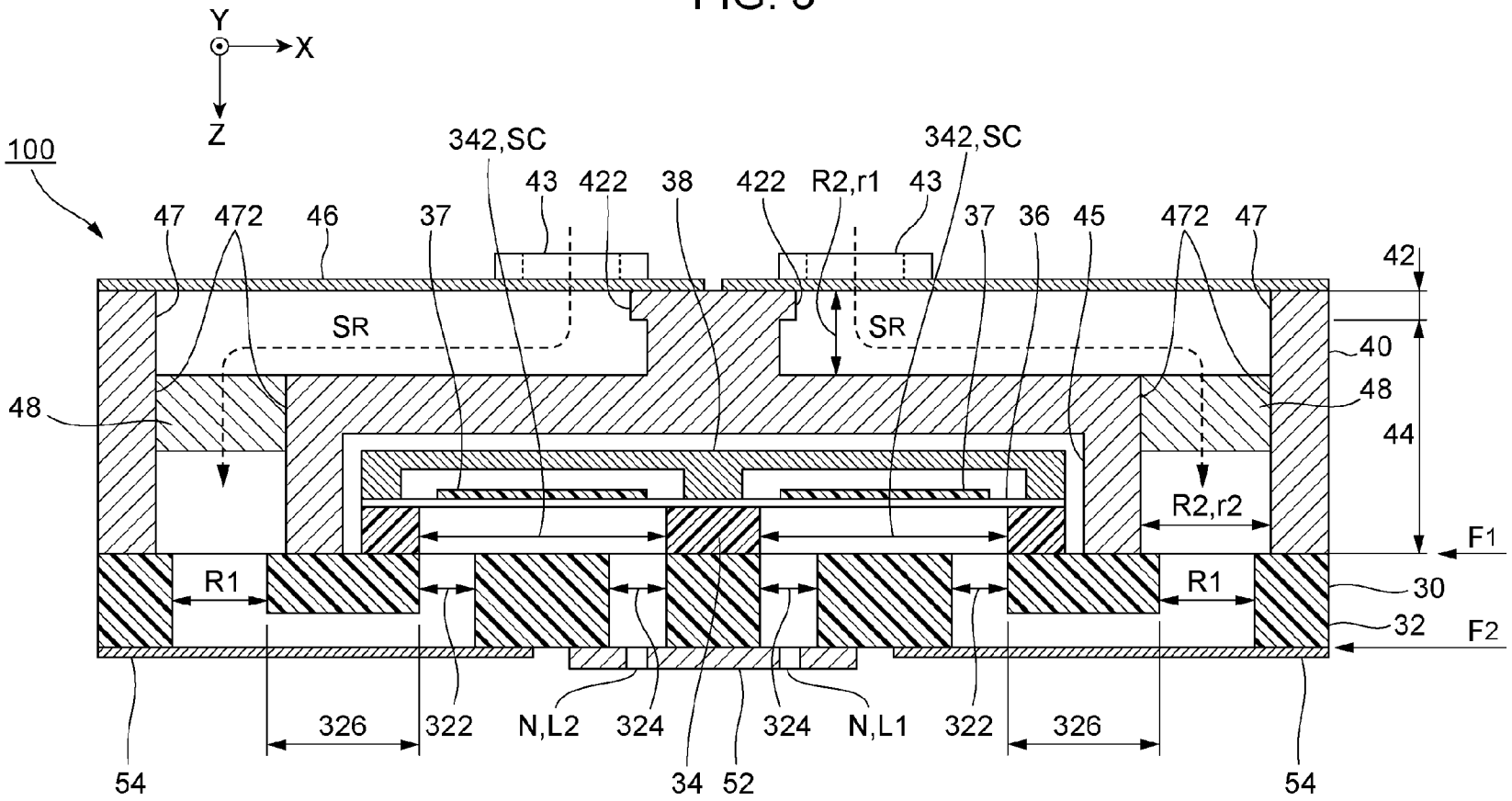
FIG. 3 is a sectional view (sectional view which is taken along line III-III in FIG. 2) of the liquid ejecting head.

FIG. 2 is an exploded perspective view of one arbitrary liquid ejecting head 100, and FIG. 3 is a sectional view which is taken along line III-III in FIG. 2. As exemplified in FIG. 2, the liquid ejecting head 100 of the embodiment includes a head main body 30 in which nozzles N ejecting ink are formed, and a housing 40 fixed to the head main body 30.

As illustrated in FIG. 2, the head main body 30 includes a nozzle plate 52 on which the plurality of nozzles N are formed. The plurality of nozzles N are divided into a first column L1 and a second column L2 arranged along the Y direction. The first column L1 and the second column L2 are separated from each other in the X direction, and positions of the nozzles N in the Y direction are different from each other between the first column L1 and the second column L2. That is, the plurality of nozzles N are subjected to a staggered arrangement. As is understood from FIG. 2, the liquid ejecting head 100 according to the embodiment has a structure in which elements related to the plurality of nozzles N of the first column L1, and elements related to the plurality of nozzles N of the second column L2 are arranged approximately in line symmetry. Therefore, in the following descriptions, the elements related to each nozzle N of the first column L1 will be paid attention to, for convenience, and descriptions of the elements related to each nozzle N of the second column L2 will be appropriately omitted.

As exemplified in FIGS. 2 and 3, the liquid ejecting head 100 according to the first embodiment includes a flow path substrate 32. The flow path substrate 32 is a plate-shaped member which includes a first face F1 and a second face F2. The first face F1 is a surface on the negative side in the Z direction, and the second face F2 is a surface on a side opposite to the first face F1 (positive side in Z direction). A pressure chamber substrate 34, a vibrating unit 36, a plurality of piezoelectric elements 37, a protecting member 38, and a housing 40 are provided on the first face F1 of the flow path substrate 32, and the nozzle plate 52, and a compliance unit 54 are provided on the second face F2. Each of the elements of the liquid ejecting head 100 is schematically a plate-shaped member which is long in the Y direction similarly to the flow path substrate 32, and the elements are bonded to each other using an adhesive, for example.

The nozzle plate 52 is a plate-shaped member on which the plurality of nozzles N are formed, and is provided on the second face F2 of the flow path substrate 32 using an adhesive, for example. Each nozzle N is a through hole through which ink passes. The nozzle plate 52 is manufactured by processing a single crystal substrate of silicon (Si) using a semiconductor manufacturing technology (for example, etching). However, when manufacturing the nozzle plate 52, it is possible to arbitrarily adopt a well-known material or manufacturing method.

Figure 4:
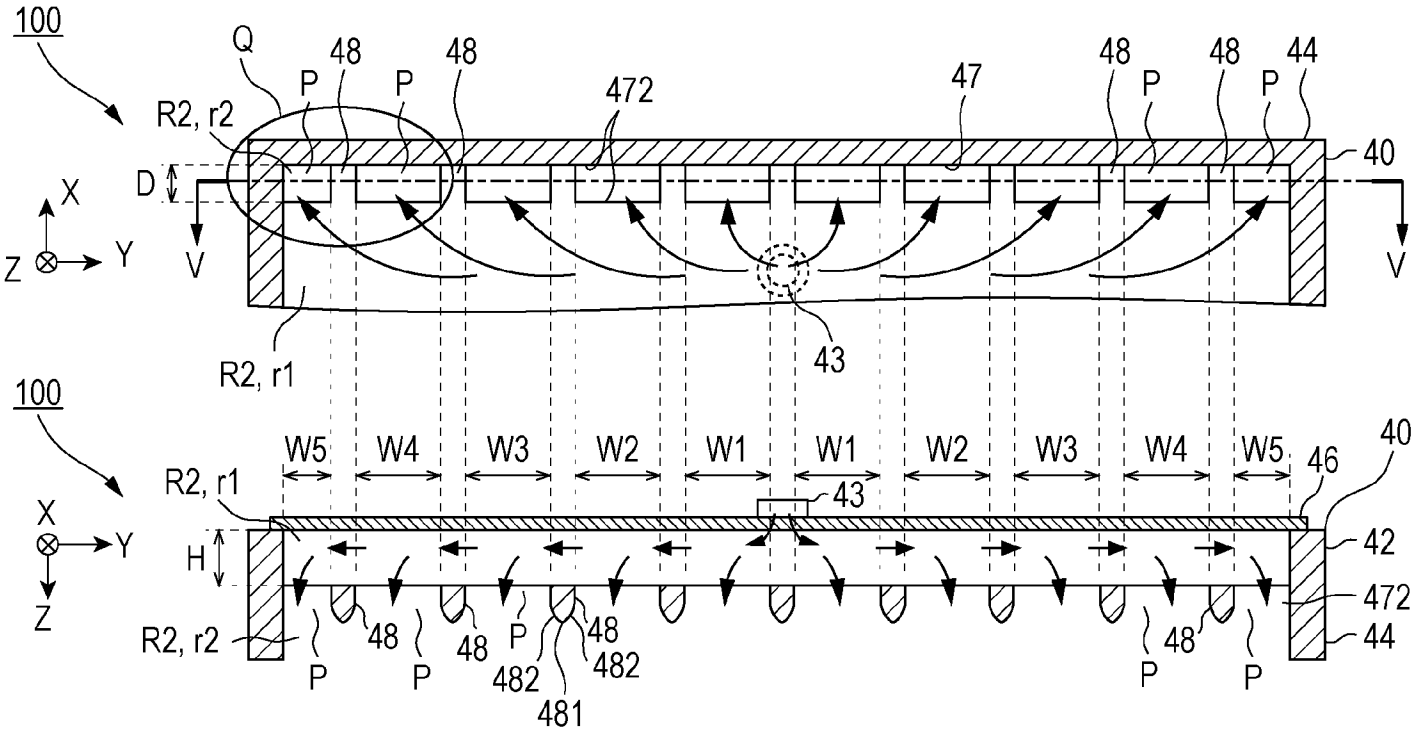
FIG. 4 is a plan view of a housing.

The flow path substrate 32 is a plate-shaped member for forming a flow path of ink. A space R1, a plurality of supply holes 322 and a plurality of communicating holes 324 are formed in the flow path substrate 32. The space R1 is an opening which is formed in a long shape along the Y direction in a planar view (that is, when viewed in Z direction), and the supply holes 322 and the communicating holes 324 are through holes (opening which is formed over the first face F1 and second face F2) which are formed in each nozzle N. The plurality of supply holes 322 are arranged in the Y direction, and the plurality of communicating holes 324 are also formed in the Y direction, similarly. Arrangements of the plurality of supply holes 322 are located between arrangements of the plurality of communicating holes 324 and the space R1. In addition, as illustrated in FIGS. 3 and 4, a plurality of branching paths 326 which correspond to supply holes 322 which are different from each other are formed on the second face F2 of the flow path substrate 32. Each branching path 326 is a groove-shaped flow path which extends along the X direction so as to connect the space R1 to the supply hole 322. Meanwhile, one arbitrary communicating hole 324 overlaps one nozzle N in a planar view. That is, a nozzle N communicates with a communicating hole 324.

As exemplified in FIGS. 2 and 3, the pressure chamber substrate 34 is a plate-shaped member on which a plurality of pressure chamber spaces 342 are arranged along the Y direction, and is provided on the first face F1 of the flow path substrate 32 using an adhesive, for example. The pressure chamber space 342 is a long through hole which goes along the X direction in a planar view which is formed in each nozzle N. As illustrated in FIG. 3, an end portion on a positive side of one arbitrary pressure chamber space 342 in the X direction overlaps one communicating hole 324 of the flow path substrate 32 in a planar view. Accordingly, a pressure chamber space 342 and a nozzle N communicate with each other through the communicating hole 324.

On the other hand, an end portion on the positive side of the pressure chamber space 342 in the X direction overlaps one supply hole 322 of the flow path substrate 32 in a planar view. As is understood from the above descriptions, since the supply hole 322 functions as a diaphragm flow path which causes the space R1 and the pressure chamber space 342 to communicate at a predetermined flow path resistance, it is not necessary to form a diaphragm flow path in the pressure chamber substrate 34. Therefore, a simple rectangular pressure chamber space 342 of which a width is maintained at a predetermined flow path width is formed in the pressure chamber substrate 34 according to the embodiment over the entire length in the X direction. That is, the diaphragm flow path in which a flow path area is partially constricted is not formed in the pressure chamber substrate 34. Accordingly, it is possible to reduce a size of the pressure chamber substrate 34 compared to a configuration in which the diaphragm flow path is formed in the pressure chamber substrate 34, and to realize miniaturization of the liquid ejecting head 100.

The flow path substrate 32 and the pressure chamber substrate 34 are manufactured by processing a single crystal substrate of silicon (Si) using a semiconductor manufacturing technology, for example, similarly to the above described nozzle plate 52. However, when manufacturing the flow path substrate 32 and the pressure chamber substrate 34, it is possible to arbitrarily adopt a well-known material or manufacturing method.

As exemplified in FIGS. 2 and 3, the vibrating unit 36 is provided on the surface of the pressure chamber substrate 34 on a side opposite to the flow path substrate 32. The vibrating unit 36 is a plate-shaped member (vibrating plate) which can be elastically vibrated. In addition, in FIGS. 2 and 3, a configuration in which the vibrating unit 36 which is separately formed from the pressure chamber substrate 34 is fixed to the pressure chamber substrate 34 is illustrated; however, it is also possible to integrally form the pressure chamber substrate 34 and the vibrating unit 36 by selectively removing a part of a region corresponding to the pressure chamber space 342 in the plate thickness direction, in a plate-shaped member with a predetermined plate thickness.

As is understood from FIG. 3, the first face F1 of the flow path substrate 32 and the vibrating unit 36 face each other with an interval in the inside of each pressure chamber space 342 of the pressure chamber substrate 34. A space between the first face F1 of the flow path substrate 32 and the vibrating unit 36 in the inside of each pressure chamber space 342 functions as a pressure chamber SC for applying pressure to ink which is filled in the space. The pressure chamber SC is individually formed in each nozzle N. As is understood from the above descriptions, the pressure chamber space 342 formed in the pressure chamber substrate 34 is a space which is formed so as to be the pressure chamber SC.

As exemplified in FIGS. 2 and 3, the plurality of piezoelectric elements 37 which correspond to nozzles N which are different from each other are provided on a plane of the vibrating unit 36 on a side opposite to the pressure chamber SC. The piezoelectric element 37 is a passive element which is vibrated when a driving signal is supplied. The plurality of piezoelectric elements 37 are arranged in the Y direction so as to correspond to each pressure chamber SC. The piezoelectric element 37 is configured of a pair of electrodes which face each other, and a piezoelectric layer which is stacked between the electrodes. The protecting member 38 in FIGS. 2 and 3 is a structure body for protecting the plurality of piezoelectric elements 37, and is fixed to the surface of the vibrating unit 36 using an adhesive, for example. The plurality of piezoelectric elements 37 are accommodated in the inside of a space (recessed portion) which is formed on a face of the protecting member 38 which faces the vibrating unit 36.

The housing 40 is a case for storing ink which is supplied to the plurality of pressure chambers SC. The surface of the housing 40 on the positive side in the Z direction (hereinafter, also referred to as "bonding face") is fixed to the first face F1 of the flow path substrate 32 using an adhesive, for example. The housing 40 is formed of a material which is different from that of the flow path substrate 32 or the pressure chamber substrate 34. For example, it is possible to manufacture the housing 40 using injection molding, using a resin material, for example. However, when manufacturing the housing 40, it is possible to arbitrarily adopt a well-known material or manufacturing method.

Figure 5:
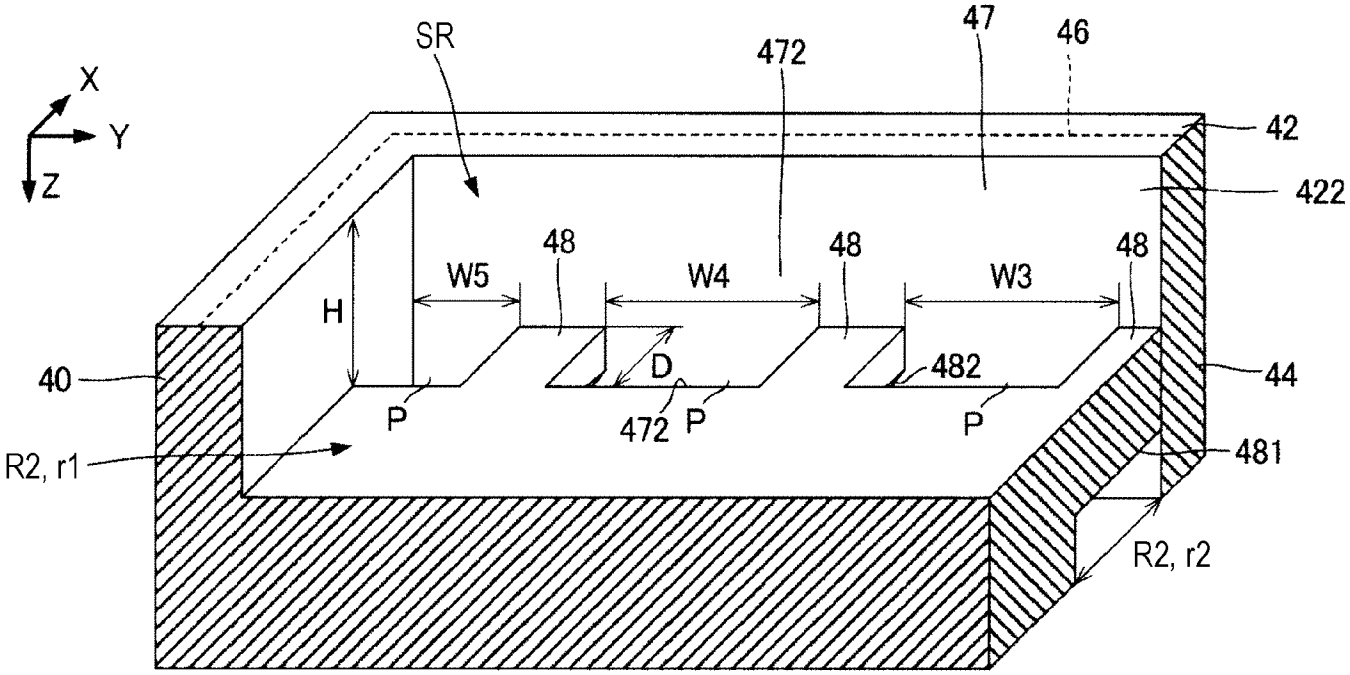
FIG. 5 is a perspective view enlargedly illustrating a beam-shaped unit.

FIG. 5 is a plan view of the housing 40 which is viewed from the flow path substrate 32 side (positive side in Z direction). As exemplified in FIGS. 3 and 5, the housing 40 is a structure body in which a space R2 is formed. The space R2 is a recessed portion to which the flow path substrate 32 side is open, and is formed in a long shape in the Y direction. As illustrated in FIG. 3, for example, the space R2 includes a first portion r1 and a second portion r2. The first portion r1 and the second portion r2 intersect each other in a different direction. Specifically, the first portion r1 extends in a direction parallel to the X-Y plane, and the second portion r2 extends in a direction orthogonal to the X-Y plane. Since ink flows from the first portion r1 toward the second portion r2, the second portion r2 is a space on the downstream side in flowing of ink (the flow path substrate 32 side) when viewed from the first portion r1. In addition, an accommodating space 45 which accommodates the protecting member 38 and the pressure chamber substrate 34 is formed between a space R2 corresponding to the first column L1 and a space R2 corresponding to the second column L2.

As exemplified in FIGS. 2 and 3, the housing 40 includes a top face portion 42 and a side face portion 44. The side face portion 44 is a portion which is fixed to the first face F1 so as to protrude from the first face F1 on the negative side in the Z direction along the peripheral edge of the flow path substrate 32. The base of the side face portion 44 is bonded to the first face F1 of the flow path substrate 32 as a bonding face. As is understood from FIG. 3, an outer wall face of the side face portion 44 (surface on a side opposite to inner wall face on space R2 side), and a side end face of the flow path substrate 32 are located on approximately the same plane (so-called flush surface). That is, an external shape of the flow path substrate 32 and an external shape of the housing 40 which are viewed in the Z direction practically match each other, and the external shape of the housing 40 does not protrude on the outer side of the outer peripheral edge of the flow path substrate 32. Accordingly, there is an advantage that it is possible to miniaturize the liquid ejecting head 100 compared to a configuration in which the housing 40 is larger than the flow path substrate 32.

The top face portion 42 of the housing 40 is a portion which is located on a side opposite to the flow path substrate 32 by interposing the space R2 therebetween. A space which is surrounded with the side face portion 44 and the top face portion 42 corresponds to the space R2. As exemplified in FIGS. 2 and 3, an introducing port 43 is formed on the top face portion 42. The introducing port 43 is a tubular portion which causes the space R2 of the housing 40 and the outside of the housing 40 to communicate. As is understood from FIG. 3, the introducing port 43 is located on a side opposite to the side face portion 44 (negative side in X direction) by interposing the second portion r2 of the space R2 therebetween in a planar view, and communicates with the first portion r1 in the space R2.

As exemplified in FIG. 3, the space R1 of the flow path substrate 32 and the space R2 of the housing 40 communicate with each other. A space which is formed by the space R1 and the space R2 functions as a liquid storage chamber (reservoir) SR. The liquid storage chamber SR is a common liquid chamber which extends over the plurality of nozzles N, and stores ink which is supplied to the introducing port 43 from the liquid container 14. As described above, the introducing port 43 is located on the negative side of the second portion r2 in the X direction. Accordingly, as illustrated in FIG. 3 using a dashed arrow, ink which is supplied to the introducing port 43 from the liquid container 14 flows to the side face portion 44 side (positive side in X direction)

in the first portion r1 of the space R2, reaches the second portion r2, and flows to the positive side in the Z direction in the second portion r2. That is, a flow path which goes from the introducing port 43 toward the side face portion 44 side is formed in the housing 40. In addition, ink which is stored in the liquid storage chamber SR is supplied to each pressure chamber SC in parallel, is filled in the pressure chamber by passing through the supply hole 322 after being branched off into the plurality of branching paths 326, and is ejected to the outside from the pressure chamber SC by passing through the communicating hole 324 and the nozzle N due to a pressure change which corresponds to a vibration of the vibrating unit 36. That is, the pressure chamber SC functions as a space in which a pressure for ejecting ink from the nozzle N is generated, and the liquid storage chamber SR functions as a space in which ink to be supplied to the plurality of pressure chambers SC is stored (common liquid chamber).

As exemplified in FIGS. 2 and 3, the compliance unit 54 is provided on the second face F2 of the flow path substrate 32. The compliance unit 54 is a flexible film, and functions as a vibration absorbing body which absorbs a pressure change of ink in the liquid storage chamber SR (space R1). As illustrated in FIG. 3, the compliance unit 54 configures a base of the liquid storage chamber SR by being provided on the second face F2 of the flow path substrate 32 so as to seal the space R1 of the flow path substrate 32, the plurality of branching paths 326, and the plurality of communicating holes 324. That is, the pressure chamber SC faces the compliance unit 54 through the communicating hole 324. In addition, in the illustration in FIG. 2, a space R1 corresponding to the first column L1 and a space R1 corresponding to the second column L2 are sealed with a separate compliance unit 54; however, it is also possible to cause one compliance unit 54 to be continuous over both of the spaces R1.

Meanwhile, as exemplified in FIGS. 2 and 3, an opening portion 422 is formed on the top face portion 42 of the housing 40. Specifically, the opening portions 422 are formed on the positive side and the negative side in the Y direction by interposing the introducing port 43 therebetween. The opening portion 422 is an opening which causes the space R2 of the housing 40 and an external space of the housing 40 to communicate. As illustrated in FIG. 2, a compliance unit 46 is provided on the surface of the top face portion 42. The compliance unit 46 is a flexible film which functions as a vibration absorbing body which absorbs a pressure change of ink in the liquid storage chamber SR (space R2), and configures a wall face (specifically, ceiling) of the liquid storage chamber SR by being provided on the outer wall face of the top face portion 42 so as to seal the opening portion 422. The compliance unit 46 is located on the upstream side of the compliance unit 54 in the liquid storage chamber SR, and is arranged in parallel to the first face F1 of the flow path substrate 32 or the compliance unit 54. In addition, in the illustration in FIG. 2, an individual compliance unit 46 is provided in each opening portion 422; however, it is also possible to adopt a configuration in which one compliance unit 46 is continuous over the plurality of opening portions 422. As is understood from the above descriptions, according to the first embodiment, the compliance units 54 and 46 are provided in order to suppress a pressure change in the liquid storage chamber SR.

As illustrated in FIG. 3, a plurality of beam-shaped units 48 are formed in the second portion r2 of the space R2 of the housing 40. FIGS. 4 and 5 are explanatory diagrams of the beam-shape unit 48. The upper part of FIG. 4 is a sectional view taken along line IV-IV of FIG. 2 when the housing 40 is viewed in the Z direction, and the lower part of FIG. 4 is a sectional view taken along line V-V of the upper part of FIG. 4 when the housing 40 is viewed from the positive side in the X direction. FIG. 5 is a perspective view enlargedly illustrating the beam-shaped unit 48, and enlargedly illustrates one corner portion Q of the housing 40 illustrated in FIG. 4. As illustrated in FIGS. 4 and 5, the beam-shaped units 48 are a plurality of beam-shaped portions of the second portion r2 of the space R2 which are stretched over a pair of inner wall faces 472 facing each other. That is, the beam-shaped unit 48 is formed in a shape which reaches the other side from one side of the pair of inner wall faces 472 which are parallel to an Y-Z plane in the second portion r2, among the inner wall faces 47 of the space R2, by protruding in the X direction. The plurality of beam-shaped units 48 are provided with intervals in the Y direction, in the second portion r2 of the space R2. The beam-shaped unit 48 can be integrally formed with the housing 40 using injection molding, using a resin material, for example. However, the beam-shaped unit 48 may be configured to be a separate member from the housing 40 and be fixed to the housing 40.

The surface of the beam-shaped unit 48 on the flow path substrate 32 side is an inclined face which is inclined to the first face F1 (X-Y plane) of the flow path substrate 32. Specifically, the surface of the beam-shaped unit 48 on the flow path substrate 32 side includes a pair of inclined faces (planar face or curved face) 482 which are located on the positive side and the negative side in the Y direction by having a ridgeline 481 along the X direction as a boundary. That is, a horizontal width (dimension in Y direction) of the beam-shaped unit 48 gradually decreases from the negative side to the positive side in the Z direction.

The plurality of beam-shaped units 48 are provided at a position which is separated from the first face F1 of the flow path substrate 32 on the negative side in the Z direction (side opposite to flow path substrate 32), and the surfaces (upper faces) of the plurality of beam-shaped units 48 on the negative side in the Z direction are located on approximately the same plane (so-called flush surface) as the inner wall face (the surface on a side opposite to the compliance unit 46) of the first portion r1 of the space R2. The space R2 of the housing 40 is divided into a space (first portion r1) on the upstream side of the plurality of beam-shaped units 48 and a space (space on the downstream side of the beam-shaped unit 48 in the second portion r2) on the downstream side of the plurality of beam-shaped units 48, by the plurality of beam-shaped units 48. In addition, the plurality of beam-shaped units 48 are disposed with intervals such that a plurality of flow paths P having the Z direction as the flow path direction are arranged on the negative side and the positive side in the Y direction from the introducing port 43. Accordingly, as indicated by arrows in FIG. 4, the ink introduced through the introducing port 43 flows from the first portion r1 to the second portion r2 by passing through the flow path P between the beam-shaped units 48. The number of beam-shaped units 48 and the number of a plurality of flow paths P are not limited to the example in the drawing.

As described above, in the embodiment, since the beam-shaped unit 48 is disposed in the space R2 of the housing 40, it is possible to improve the mechanical strength of the housing 40. Meanwhile, if the flow paths P are divided by the beam-shaped units 48, performances of discharging bubbles may be decreased. Thus, in the embodiment, the dimensions of respective flow paths P formed by the beam-shaped units 48 are set as follows. That is, if among the plurality of flow paths P formed by the beam-shaped units 48, the flow paths P far away from the introducing port 43 in the Y direction (first direction) are set as first flow paths, and the flow paths P close to the introducing port 43 are set as second flow paths, a flow path width W of each flow path P is set such that the first flow path has a flow path width W in the Y direction smaller than that of the second flow path. The flow path width W corresponds to an interval between two beam-shaped units 48 that are adjacent in the Y direction.

Specifically, as illustrated in FIG. 4, in the embodiment, the flow path widths are set as W1 to W5 from the flow paths P close to the introducing port 43 to the flow paths P far away from the introducing port 43, the flow path widths W5 of the flow paths P farthest from the introducing port 43 (that is, the flow paths P located on end portions in the Y direction) are smaller than the flow path widths W1 to W4 of the flow paths P that are closer to the introducing port 43 than the farthest flow paths P. In FIG. 4, the flow path widths W1 to W4 are the same as each other. However, the flow path widths W1 to W4 may be set such that the flow paths P far away from the introducing port 43 have flow path widths in the Y direction smaller than those of the flow paths P close to the introducing port 43.

In the embodiment, both the flow path width W in the X direction and a flow path width D in the Y direction of each flow path P are smaller than a height H in the Z direction (third direction) of the first portion r1 on the upstream side of the beam-shaped unit 48. The flow path width D corresponds to an interval between the pair of inner wall faces 472 facing each other in the space R2, and can be called a length of the beam-shaped unit 48 in the X direction.

Figure 6:
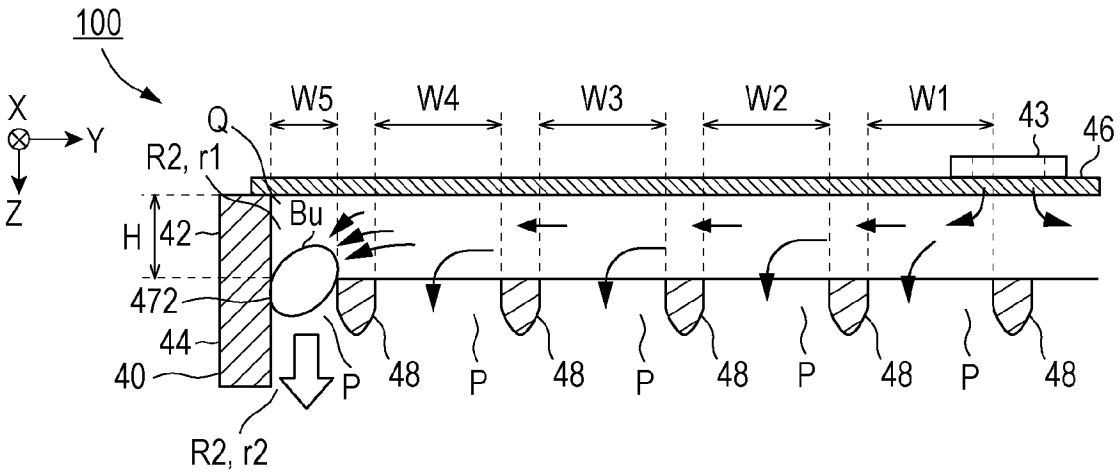
FIG. 6 is an explanatory diagram illustrating operations of the liquid ejecting head according to the embodiment.
Figure 7:
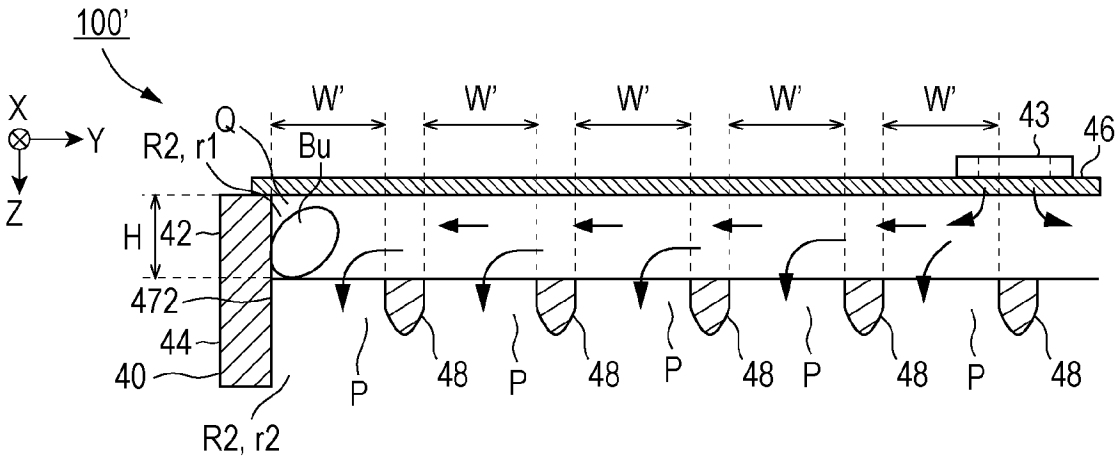
FIG. 7 is an explanatory diagram illustrating operations of a liquid ejecting head according to a comparative example.

FIG. 6 is an explanatory diagram illustrating operations of the liquid ejecting head 100 according to the embodiment, and is a part of the cross-sectional view of the lower part of FIG. 4. FIG. 7 is an explanatory diagram illustrating operations of a liquid ejecting head 100' according to a comparative example. In the comparative example of FIG. 7, all the flow path widths of the flow paths P of FIG. 6 are the same dimension W'. Accordingly, in the comparative example, the flow path width W' of the flow path P farthest from the introducing port 43 is larger than the flow path width W5 of the embodiment. Even in the comparative example of FIG. 7, similar to the embodiment of FIG. 6, the ink introduced through the introducing port 43 flows in the first portion r1 of the space R2 toward the positive side and the negative side in the Y direction, passes through the flow paths P formed by the beam-shaped units 48, and flows to the second portion r2 of the space R2. As illustrated in FIGS. 6 and 7, the bubble B mixed in the ink moves to reach the corner portion Q of the space R2 in accordance with the flow of the ink.

In the configuration in which the flow path width W' in the Y direction of the flow path P is large as in the comparative example of FIG. 7, a gap is generated between the bubble B moved to the corner portion Q and the surface of the beam-shaped unit 48 (the inner wall face of the flow path P), and ink passes (leaks) through this gap. Accordingly, as understood from FIG. 7, the bubble B is pressed against the corner portion Q to stay due to the ink passing through the gap, and the bubble B becomes difficult to be discharged from the space R2. As the flow path P is farther from the introducing port 43, the flow rate of the ink becomes reduced, and therefore, the tendency that the bubble B is difficult to be discharged becomes remarkable.

Meanwhile, in the embodiment of FIG. 6, since the flow path width W5 is smaller than the flow path width W' of the comparative example of FIG. 7, a gap is unlikely to be generated between the bubble B and the surface of the beam-shaped unit 48 (the inner wall face of the flow path P). That is, as understood from FIG. 6, the flow path P is temporarily blocked by the bubble B having reached the vicinity of the corner portion Q. Accordingly, a pressure difference is generated between the upstream side (the first portion r1) and the downstream side (the second portion r2) of the corresponding flow path P, and as a result, the bubble B is easily discharged through the flow path P. Furthermore, the flow rate of the ink is increased by setting the flow path width W5 of flow path P, which is a position where the speed of the ink from the introducing port 43 is easily decreased, to be small, and thus the bubble B is easily discharged.

In consideration of the view point of promoting the discharge of the bubble B by suppressing the formation of the gap, a configuration in which all the plurality of flow paths P have small flow path widths W can be assumed. However, in such a configuration in which the flow path widths W are small, the flow rate of the ink from the space R1 to the space R2 is limited, and as a result, the supply of the ink to each pressure chamber SC may be insufficient. In consideration of such a circumstance, in the embodiment, the configuration is adopted in which the flow path P close to the introducing port 43 has the flow path width W larger than that of the flow path P far away from the introducing port 43. That is, the flow path width W of the flow path P close to the introducing port 43 (that is, at a position where the bubble B is unlikely to stay) is sufficiently secured while the flow path width W of the flow path P on the downstream side (end portion side in the Y direction) where the bubble B easily stays is reduced. Accordingly, it is possible to easily discharge the bubble in the flow path P far from the introducing port 43 while securing the flow rate of the ink in the flow path P close to the introducing port 43.

In the embodiment, the flow path width D in the Y direction of the flow path P is smaller than the height H in the Z direction (third direction) of the first portion r1 on the upstream side of the beam-shaped unit 48. According to such a configuration, since the flow path area of the flow paths P is reduced compared to the configuration in which the flow path width D is larger than the height H, it is possible to increase the flow rate of the ink passing through the flow path P. In addition, it is possible to promote the discharge of the bubble B through the flow path P. Since the height H greater than the flow path width D is secured in the first portion r1, there is an advantage in that the flow rate of the ink flowing in a space (the first portion r1) on the upstream side of the beam-shaped unit 48 is easily secured.

In the embodiment, the flow path width W5 of the flow path P in the X direction as well as the flow path width D of the flow path P in the Y direction is smaller than the height H of the first portion r1 in the Z direction. That is, both the flow path width D in the Y direction and the flow path width W5 in the X direction of the flow path P far away from the introducing port 43 are reduced, and thus the flow path area of the flow path P can be reduced. Accordingly, the effect in which it is possible to promote the discharge of the bubble B by the suppression of the gap between the bubble B and the inner wall face of the flow path P, and by the increase of the flow rate of the ink is particularly remarkable.

The flow path width W5 of the flow path P in the X direction is smaller than the height H of the first portion r1 and the flow path width D in the Y direction may be greater than the height H. Even in such a configuration, it is possible to promote the discharge of the bubble B by increasing the flow rate of the ink flowing through the flow path P while the flow rate of the ink flowing through the first portion r1 is secured. In the embodiment, the case in which all the flow paths P have the same height H in the Z direction (third direction) of the first portion r1 on the upstream side of the beam-shaped unit 48 is described, but the heights H of the first portion r1 may be different from each other depending on the position of the flow path P. For example, the height H of the first portion r1 corresponding to the flow path P farthest from the introducing port 43 may be smaller than the heights H of other flow paths P. Specifically, a configuration in which the flow path width D of the flow path P in the Y direction and the flow path width W5 of the flow path P in the X direction are smaller than the height H of the flow path P farthest from the introducing port 43 is preferable.

In the embodiment, the space R2 of the liquid storage chamber SR includes the first portion r1 parallel to the X-Y plane and the second portion r2 orthogonal to the plane from the introducing port 43, and the beam-shaped unit 48 is formed in the second portion r2 orthogonal to the plane. According to such a configuration, when the ink flows from the first portion r1 to the second portion r2 in the space R2 of the liquid storage chamber SR, since the ink passes through the flow path P formed by the beam-shaped unit 48, at this time, it is possible to easily discharge the bubble B in the flow path P far away from the introducing port 43 while the flow rate of the liquid is secured.

In the embodiment, since the liquid storage chamber SR and the pressure chamber SC communicate through the supply hole 322 (diaphragm flow path) which is formed in the flow path substrate 32, it is possible to reduce a size of the pressure chamber substrate 34 compared to a configuration in which the diaphragm flow path is formed in the pressure chamber space 342. Accordingly, it is possible to realize miniaturization of the liquid ejecting head 100. In addition, since the compliance unit 54 is provided in the vicinity of the pressure chamber SC so as to face the pressure chamber SC by interposing the communicating hole 324, there is an advantage that it is possible to efficiently absorb a pressure change which is propagated to the liquid storage chamber SR from each pressure chamber SC through the communicating hole 324 using the compliance unit 54. Meanwhile, in a configuration in which the flow path substrate 32 is reduced in size in order to miniaturize the liquid ejecting head 100, it is difficult to sufficiently secure an area of the compliance unit 54, and a possibility that a pressure change in the liquid storage chamber SR may not be sufficiently suppressed using only the compliance unit 54 is also assumed. According to the embodiment, since the compliance unit 46 is provided in the housing 40, in addition to the compliance unit 54 of the flow path substrate 32, there is an advantage that it is possible to effectively suppress a pressure change in the liquid storage chamber SR even when the flow path substrate 32 is miniaturized compared to a configuration in which the compliance unit 46 is not provided.

Meanwhile, it is necessary to miniaturize the housing 40, as well, in order to miniaturize the liquid ejecting head 100; however, when the plate thickness of the side face portion 44 or the top face portion 42 is reduced in order to miniaturize the housing 40, there is a possibility that a mechanical strength of the housing 40 may be insufficient. According to the embodiment, since the beam-shaped unit 48 is provided in the housing 40, there is an advantage that it is possible to maintain the mechanical strength of the housing 40 even in a configuration in which the plate thickness of each unit is reduced in order to miniaturize the housing 40.

Modification Example

Each embodiment which is exemplified above can be variously modified. Specific modification example will be described below. Two or more examples which are arbitrarily selected from the following examples can be appropriately combined in a range of not conflicting each other.

(1) In each embodiment described above, a case where the space R2 of the liquid storage chamber SR where the beam-shaped unit 48 is provided is configured to be divided into the first portion r1 and the second portion r2 intersecting in different directions is described. However, the first portion r1 and the second portion r2 may be integrally configured so as to communicate with each other in the same direction without intersecting each other.

(2) In each embodiment described above, one housing 40 is provided with respect to one flow path substrate 32; however, it is also possible to provide one housing with respect to a plurality of the flow path substrates 32.

(3) In each embodiment described above, the compliance unit 46 is provided on the top face portion 42 of the housing 40; however, it is possible to provide the compliance unit on the side face portion 44 of the housing 40. In this case, it is possible to provide the compliance unit 46 on both the top face portion 42 and the side face portion 44 of the housing 40.

(4) The element (driving element) which applies a pressure into the pressure chamber SC is not limited to the piezoelectric element 37 which is exemplified in each embodiment which is described above. For example, it is also possible to use a heating element which causes a pressure change by generating bubbles in the inside of the pressure chamber SC using heating, as a driving element. As is understood from the above examples, the driving element is comprehensively expressed as an element for ejecting liquid (typically, element which applies pressure into pressure chamber SC), and an operation method (piezoelectric method or heating method) or specific configuration thereof does not matter.

(5) In each embodiment which is described above, a serial head in which the carriage 26 on which the plurality of liquid ejecting heads 100 are mounted moves in the X direction is exemplified; however, it is also possible to apply the invention to a line head in which a plurality of liquid ejecting heads 100 are arranged in the X direction.

(6) The printing apparatus 10 which is exemplified in each embodiment which is described above can be adopted to various devices such as a fax machine or a copy machine, in addition to a device which is exclusive to printing. Originally, a use of the liquid ejecting apparatus in the invention is not limited to printing. For example, a liquid ejecting apparatus which ejects a solution of a coloring material is used as a manufacturing device which forms a color filter of a liquid crystal display device. In addition, a liquid ejecting apparatus which ejects a solution of a conductive material is used as a manufacturing device which forms wiring or an electrode of a wiring substrate.

The entire disclosure of Japanese Patent Application No. 2015-188416, filed Sep. 25, 2015 is expressly incorporated by reference herein in its entirety.

What is claimed is:

1. A liquid ejecting head comprising:

a head main body in which a plurality of nozzles ejecting liquid are arranged along a first direction, the head main body including a flow path substrate;

a housing fixed to the head main body, wherein the housing is fixed to an outer portion of the flow path substrate;

a liquid storage chamber that includes a space formed in the housing, and stores the liquid supplied to the nozzles;

an introducing port of the liquid communicating with the liquid storage chamber; and a plurality of beam-shaped units that are stretched over an inner wall face of the space in the housing, wherein the plurality of beam-shaped units are provided with intervals such that a plurality of flow paths are arranged in the first direction from the introducing port, and wherein the plurality of flow paths includes a first flow path and a second flow path, the first flow path is further away from the introducing port in the first direction than the second flow path, the first flow path has a flow path width in the first direction smaller than a flow path width in the first direction of a second flow path.

2. The liquid ejecting head according to claim 1, wherein the liquid storage chamber includes a first space on an upstream side of the plurality of beam-shaped units, and a second space on a downstream side of the plurality of beam-shaped units, and wherein the flow path width of the first flow path in a second direction intersecting the first direction is smaller than a height of the first space in a third direction orthogonal to both the first direction and the second direction.

3. The liquid ejecting head according to claim 2, wherein the flow path width of the first flow path in the first direction is smaller than the height of the first space in the third direction.

4. The liquid ejecting head according to claim 2, wherein the liquid storage chamber includes, from the introducing port, a portion parallel to a plane including the first direction and the second direction, and a portion orthogonal to the plane, and wherein the beam-shaped unit is formed in the orthogonal portion in the liquid storage chamber.

5. A liquid ejecting apparatus comprising:

a transport mechanism that transports a medium; and the liquid ejecting head according to claim 1 which ejects liquid onto the medium.

6. A liquid ejecting apparatus comprising:

a transport mechanism that transports a medium; and the liquid ejecting head according to claim 2 which ejects liquid onto the medium.

7. A liquid ejecting apparatus comprising:

a transport mechanism that transports a medium; and the liquid ejecting head according to claim 3 which ejects liquid onto the medium.

8. A liquid ejecting apparatus comprising:

a transport mechanism that transports a medium; and the liquid ejecting head according to claim 4 which ejects liquid onto the medium.

* * * * *